United States Patent [19]

May

[11] Patent Number: 5,018,890

[45] Date of Patent: May 28, 1991

[54] POOL CLEANING SYSTEM

[75] Inventor: Brian E. May, Amsterdam, N.Y.

[73] Assignee: North Broadway Corp., Saratoga Springs, N.Y.

[21] Appl. No.: 348,391

[22] Filed: May 8, 1989

Related U.S. Application Data

[63] Continuation-in-part of Ser. No. 179,405, Apr. 8, 1988, abandoned.

[51] Int. Cl.[5] ..... E04H 3/20; B08B 5/04

[52] U.S. Cl. ..... 401/46; 15/98; 15/1.7; 134/21; 134/3; 134/167 R

[58] Field of Search ..... 15/1.7, 98; 134/21, 134/3, 167 R, 40–43; 401/203, 149, 46; 114/222 R

[56] References Cited

U.S. PATENT DOCUMENTS

| | | | |
|---|---|---|---|
| 745,406 | 3/1903 | LeBonte' | 401/43 |
| 1,111,768 | 9/1914 | Spencer | 401/40 |
| 2,572,538 | 10/1951 | Teters | 401/46 |
| 2,647,273 | 8/1953 | Eagle | 401/203 |
| 3,080,590 | 3/1973 | Mullinex | 15/1.7 |
| 3,142,084 | 7/1964 | McMullen | 15/524 |
| 3,163,880 | 1/1965 | Johnson | 15/526 |
| 3,694,263 | 9/1972 | Korn | 134/3 |
| 3,707,737 | 1/1973 | Brower | 15/1.7 |
| 3,928,947 | 12/1975 | Millett | 51/170 T |
| 4,009,049 | 2/1977 | Pansini | 134/21 |
| 4,032,239 | 6/1977 | Maupin | 401/203 |
| 4,152,802 | 5/1979 | Chavier | 15/1.7 |
| 4,270,484 | 6/1981 | Shimatani et al. | 118/305 |
| 4,301,828 | 11/1981 | Martin, Jr. | 137/381 |
| 4,324,015 | 4/1982 | Head | 15/49 |
| 4,383,779 | 5/1983 | Khanzadian et al. | 401/15 |
| 4,629,347 | 12/1986 | Poppitz | 401/42 |
| 4,656,683 | 4/1987 | Raubenheimer | 15/1.7 |

*Primary Examiner*—Richard J. Johnson

*Attorney, Agent, or Firm*—Kenyon & Kenyon

[57] ABSTRACT

A portable pool cleaning system for cleaning the surfaces of swimming pools and surrounding decks without draining the pool water. The system includes a cart for containing an electrically powered pump, a line to an external source of muriatic acid or another suitable swimming pool cleaning agent and a line to a clean water source. The system also includes a cleaning wand having a cleaning head for engagement with the pool walls and floor. A valving system is used to regulate the flow of a cleaning agent through the system, to dilute the muriatic acid with water from the clean water source, and to recirculate through the system any unused portion of muriatic acid which is prevented from flowing to the cleaning wand. The valving system further allows the operator to flush the system with clean water before withdrawing the cleaning wand from the pool water. A cylindrical safety shield is provided for each valve in case of leakage in order to prevent serious damage to system elements, objects external to the system, and persons within the pool vicinity. Switches wired in series with the pump switch are closed only when the safety shields are in place, thus preventing use of the cleaning system without this safety feature.

25 Claims, 6 Drawing Sheets

POOL CLEANING SYSTEM

RELATED APPLICATION

This application is a continuation-in-part of U.S. application Ser. No. 179,405 filed Apr. 8, 1988, now abandoned.

FIELD OF THE INVENTION

The present invention relates generally to swimming pool cleaning systems. More particularly, this invention is directed to a portable system for thoroughly cleaning swimming pool walls and floors and surrounding decks without draining the pool water. The present invention also relates to both apparatus and methods for cleaning the surfaces of swimming pools and surrounding areas without draining water from the pool.

BACKGROUND OF THE INVENTION

Several types of pool cleaning systems which perform different cleaning functions are presently available. For example, vacuum cleaners for removing dirt particles and debris from pool surfaces are commonly used. Other devices involve the use of abrasive surfaces for scrubbing the walls and floors of swimming pools. Yet another type of device combines abrasive scrubbing surfaces with high-pressure jets of water for cleaning.

None of the aforementioned devices are adequate for the removal of tough stains from pool surfaces. To accomplish stain removal, the normal procedure is to periodically drain the water from the pool and then to apply a cleaning agent, commonly muriatic acid, to the walls and floor of the swimming pool. Unfortunately, this is an expensive and time-consuming process. Moreover, the use of muriatic acid with present devices, which generally do not adequately protect the user from accidental contact with the acid or overexposure to its fumes, is frequently a dangerous procedure. Therefore, the usual practice is to wait a few years before a thorough cleaning effort is undertaken. At that point, however, some stains may be impossible to remove.

Devices are presently available for spot cleaning pool surfaces with chemicals. However, since these devices are suitable only for spot cleaning, a thorough chemical cleaning of the entire pool surfaces nevertheless should be undertaken at some point. Disadvantageously, these devices are generally dangerous to use. In particular, any mixing of chemicals is done manually by the operator before use; thus, there is the ever present danger of contact between the human skin and the chemicals, resulting in serious injury. In addition, the inhalation of fumes may cause harmful side effects. And, during a cleaning operation, leakage of muriatic acid from these devices at mechanical interconnections also pose a serious danger of injury. Moreover, mechanical components of the pool are frequently damaged by contact with the acid or by exposure to its fumes.

The present inventor has overcome the problems of the prior art devices by developing a portable chemical cleaning system for swimming pools which does not require the draining of pool water and which when operated properly is relatively safe, effective, and convenient to use.

The major advantages of the invention are set forth in part herein and in part will be obvious herefrom, or may be learned by practice with the invention, the same being realized and attained by means of the instrumentalities and combinations pointed out in the appended claims.

SUMMARY OF THE INVENTION

The present invention is directed to a swimming pool cleaning system including a portable cart therefor and a cleaning wand. An electrically powered, motor-driven pump is contained within the cart for delivering a cleaning agent, such as muriatic acid, from an externally, proximately located carboy to the cleaning wand. In addition, a line to a clean water supply is provided both for making an acid-water mixture, if desired, and for flushing the system after use. Manually controllable valves are used to regulate and to direct muriatic acid and water flow, as well as pressure, within the system. As a further feature, flow meters are used at various points within the system to monitor liquid flow.

During a cleaning operation, muriatic acid is pumped from the carboy, through a first carboy valve, then successively through a wand valve and a check valve to the cleaning head of the wand. The cleaning head is pivotally mounted to the wand handle so that the cleaning head is maintained in a position parallel to the work surface as it is either moved across the pool surface during a thorough cleaning operation or as it is held stationary for spot cleaning. Muriatic acid not passing through the wand valve, which has been preset to allow for a specific flow rate, passes through the recirculation valve, thus returning to the carboy for subsequent use.

Upon completion of the cleaning operation, the system is flushed before withdrawing the cleaning wand from the pool. This is accomplished by closing the first carboy valve and the recirculation valve and then opening the water source valve. Water is then pumped through the system and into the pool. In this way, damage to system elements, external objects, and the system operator caused by leakage of acid remaining within the wand and system conduits after use is avoided.

In order to make the pool chemically safe for swimmers after a cleaning operation, the cleaning wand may be used like a hose to add a neutralizing agent, such as a carbonate, to the pool water. Finally, any solids that have precipitated to the pool bottom during the cleaning operation may be removed by vacuuming.

The pool cleaning system of the present invention incorporates further safety features. These include the placing of safety shields over all valves. Safety switches wired in series with the system power switch are not activated until the safety shields are closed. Thus, system operators, as well as system and external elements, are generally protected from the deleterious and corrosive effects of muriatic acid in case of leakage from the valves.

The present invention is also directed to an apparatus for cleaning the surfaces of a swimming pool and surrounding areas. The apparatus comprises fluid conduits connectable to a source of liquid cleaning agent for the flow of cleaning agent therethrough. Valves of the apparatus are also connected to the conduits for controlling the flow of fluid through the conduits. The apparatus further includes a cleaning member connectable to the conduits for receiving cleaning agent or other fluid from the conduits and for directing cleaning agent against the surfaces to be cleaned. The cleaning member defines a cleaning surface adapted for substantial conformable engagement with the surfaces to be cleaned. The cleaning surface has formed therein a cavity in fluid communication with the fluid conduits when the cleaning member is connected thereto for receiving cleaning agent or other fluid therefrom. The cleaning member is submerged in the pool and the cleaning surface is engageable with the surfaces to be cleaned, for directing the flow of cleaning agent through the cavity and against those surfaces. The pool surfaces therefore are cleaned without removing any water from the pool.

In a further embodiment, the apparatus comprises a pump in fluid communication with the fluid conduits for pumping cleaning agent or other fluid through the conduits. The conduits of the apparatus are also connectable to a source of water for pumping water therethrough. The cleaning agent therefore can be diluted with water and/or the apparatus can be flushed with water after cleaning a pool.

In yet another embodiment of the invention, the cleaning member of the apparatus includes a handle member having a fluid conduit mounted therein. The fluid conduit of the handle member is in fluid communication with the fluid conduits for receiving cleaning agent or other fluid therefrom. The cleaning member further includes a cleaning head connected to one end of the handle member. The cleaning head defines a cleaning surface formed for substantial conformable engagement with the surfaces to be cleaned. The cleaning head further defines a cavity formed within the cleaning surface in fluid communication with the handle fluid conduit for receiving cleaning agent or other fluid therefrom. The cleaning surface is slideably engaged over the pool surfaces for directing the flow of cleaning agent through the cavity against the surfaces to be cleaned.

In yet a further embodiment of the invention the cleaning head defines a ballast cavity. The ballast cavity is in fluid communication with the pool water when the cleaning head is submerged in the pool for receiving water therefrom. When the ballast cavity receives water, the cleaning head substantially loses its buoyancy for facilitating movement of the cleaning head over the submerged surfaces to be cleaned.

The invention is also directed to a method for cleaning the surfaces of a swimming pool and surrounding areas without draining the water from the pool. The method comprises the steps of: (a) pumping a liquid cleaning agent through a cleaning member at a flow rate less than about 5 gallons per minute, the cleaning member having a cleaning head attached to one end thereof and a fluid conduit defined therein, the fluid conduit being in fluid communication with the source of liquid cleaning agent for directing the flow of liquid cleaning agent against the surfaces to be cleaned; (b) slideably engaging the cleaning head over the surfaces to be cleaned to direct the discharge of liquid cleaning agent against those surfaces to remove stains therefrom; and then (c) introducing a neutralizing agent into the pool water to neutralize the liquid cleaning agent in the pool and restore the pool to a chemically safe condition for swimmers.

The invention consists in the novel parts, constructions, combinations and improvements herein shown and described.

The accompanying drawings referred to herein and constituting a part hereof illustrate preferred embodiments of the invention and together with the description, serve to explain principles of the invention.

DETAILED DESCRIPTION OF THE DRAWINGS

Figure 1:
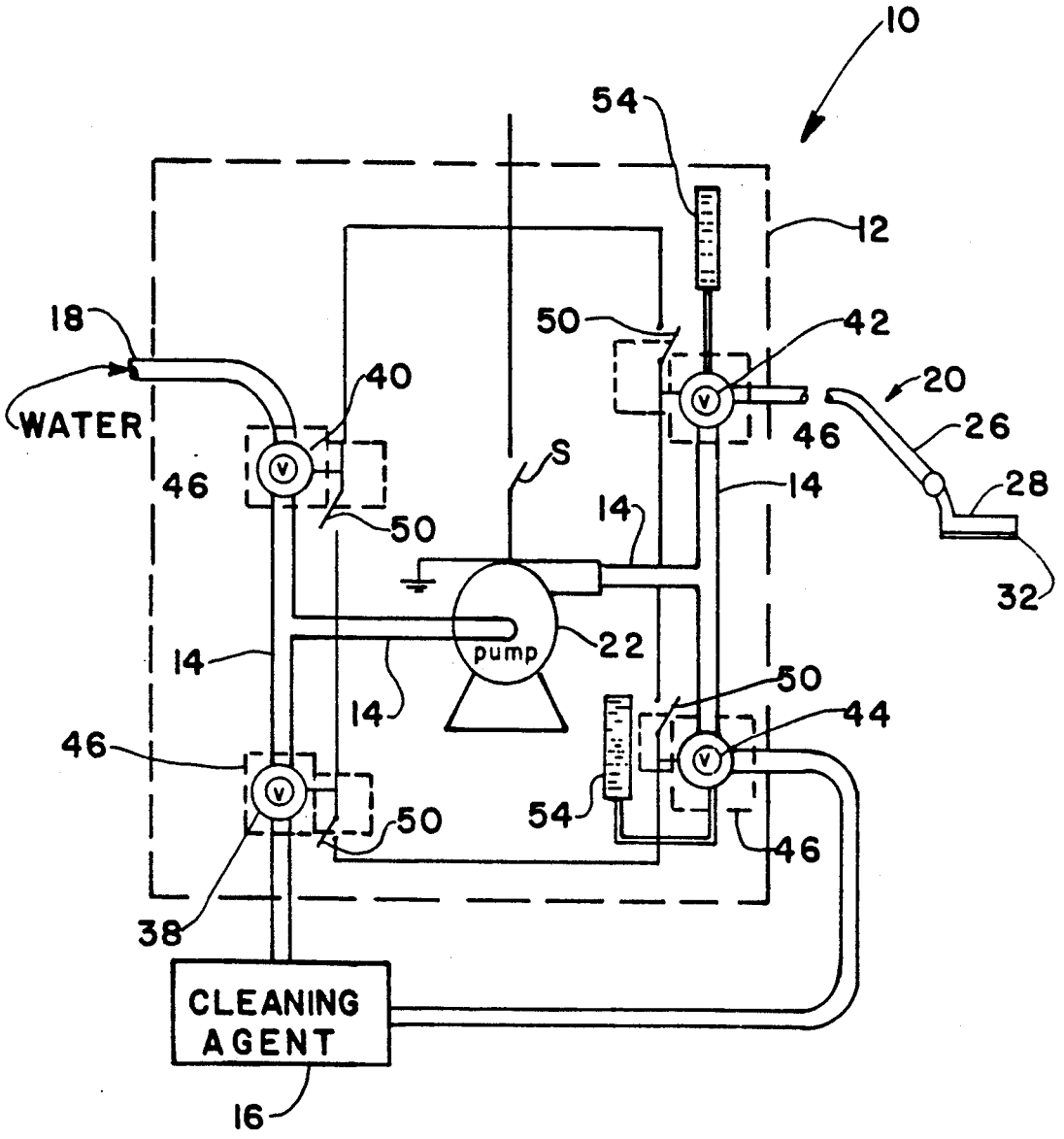
FIG. 1 is a schematic diagram of the pool cleaning system of the present invention.

With reference to FIG. 1, a schematic diagram of the pool cleaning apparatus of the present invention, generally designated by the numeral 10, is shown. The pool cleaning system is portable; a cart, the periphery of which is shown in phantom and is designated by the numeral 12, contains system elements for the easy and convenient transport thereof.

System conduits 14 comprising pipes or tubing within the cart 12 are connected to an external carboy 16 containing muriatic acid or any other suitable liquid cleaning agent. The system conduits 14 are also connected to an external source of water at the point in the schematic diagram designated by the numeral 18 by a hose, such as a conventional garden hose. A cleaning wand 20 for receiving muriatic acid and/or water for application to the pool is likewise removably attachable to the cart 12. In operation, a pump 22 located within the cart 12 delivers muriatic acid and water from the external liquid sources through the conduits 14 to the cleaning wand 20.

Figure 2A:
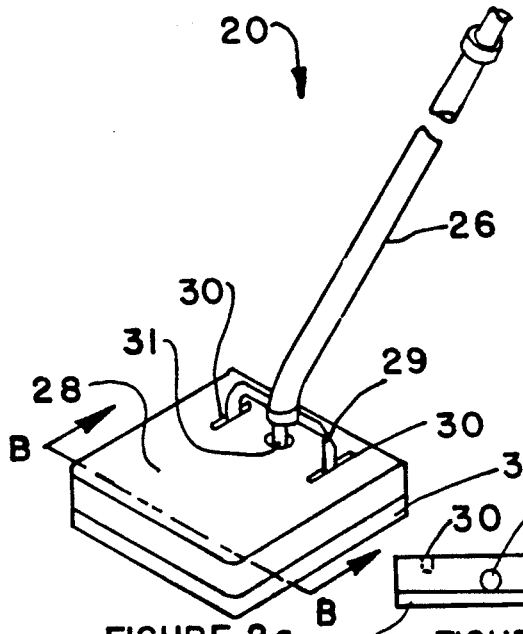
FIG. 2*a* is an isometric view of the cleaning wand used in the pool cleaning system of FIG. 1.
Figure 2B:
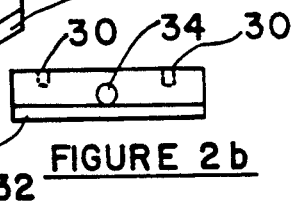
FIG. 2*b* is a cutaway view of the cleaning head of the wand of FIG. 2*a* taken along line B—B.

The cleaning wand 20, shown in greater detail in FIGS. 2*a* and 2*b*, is connected at one end to the system conduits 14 by a flexible hose of variable length. The wand handle 26 is telescoping, thereby enabling easy length adjustment. A cleaning head 28 is pivotally mounted to the other end of the cleaning wand 20. In the preferred embodiment as shown in FIG. 2*a*, the combination of a bracket 29 sliding within guide slots 30 and a piece of flexible hose or tubing 31 enables the parallel engagement of the cleaning head 28 with the surfaces to be cleaned as it is moved by the operator. It is to be understood, however, that any appropriate joint permitting pivotal movement of the cleaning head 28 with respect to the wand handle 26 may be used. A permeable scrubbing surface 32 comprising a resilient sponge pad is attached to the underside of the cleaning head 28 for cleaning engagement with the pool and deck surfaces. The cleaning head 28 is preferably constructed of plastic and has a passageway or cavity 34 formed therein for filling with the cleaning agent and/or water at a variable rate, depending upon the valve settings.

In the preferred embodiment of the present invention, the pump 22 is electrically powered, being driven by a motor (not shown) and activated by the system switch S.

Figure 3:
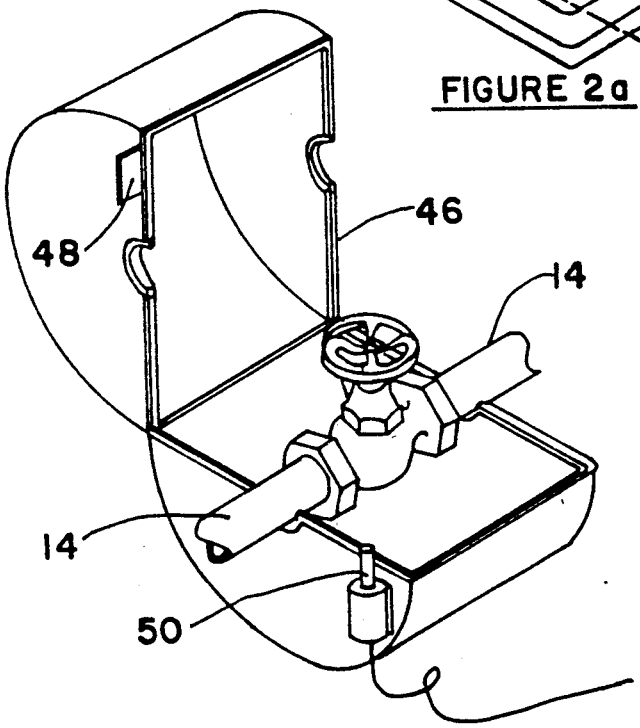
FIG. 3 is an isometric view of a single valve and its associated safety shield as constructed in accordance with the preferred embodiment of the present invention.

A valving system comprising a number of manually controlled valves 38, 40, 42, and 44 for regulating the flow of liquids in the pool cleaning system, is illustrated in the schematic diagram of FIG. 1. A single valve of the type employed in the present invention is shown in greater detail in FIG. 3. Each valve is encased within a safety shield 46 for containing muriatic acid in case of leakage. In the preferred embodiment, the safety shields 46 are cylindrical and are made of plastic, but any suitable noncorrosive material may be used. A hinge along one side of the shield 46, extending parallel to the principal axis thereof, enables the user to manually open and close the shield 46.

At the opening of each safety shield 46, a push button safety switch 50 is located. When the safety shield 46 is closed, a protrusion 48 from the shield 46 activates the safety switch 50. As illustrated in FIG. 1, each of the above described safety switches 50 is wired in series with the system switch S so that the pool cleaning system 10 is inoperable unless all valve safety shields 46 are closed. In this way, the system operator, system elements, and external objects are protected from the deleterious and corrosive effects of muriatic acid in case of leakage from the valves 46 and subsequent contact therewith.

In operation, with the safety shields 46 closed and the system switch S activated, the pool cleaning system of the present invention may be employed to thoroughly clean pool surfaces and surrounding decks without draining the water from the pool. In order to use the cleaning wand 20 to apply muriatic acid to the pool surfaces, the first carboy valve 38 and the wand valve 42 must be opened. The liquid cleaning agent is then pumped from the carboy 16 to the cleaning wand 20. A check valve in the wand handle 26 (not shown) ensures that the muriatic acid which has been delivered to the wand 20 flows in one direction only, toward the cleaning head 28. As the muriatic acid is pumped to the wand, it collects in and is discharged from the cavity or passageway 34 of the cleaning head 28 at a rate determined by the degree to which the valves 38 and 42 have been manually opened. The system operator moves the wand 20 over the pool surfaces at a rate deemed appropriate to accomplish a thorough cleaning operation as the cleaning head 28 is maintained in parallel engagement therewith by means of the above described pivotal connection.

During a cleaning operation, a second carboy valve 44 may be opened to permit recirculation through the pool cleaning system of any unused portion of muriatic acid which has not been allowed by the wand valve 42 to flow to the cleaning head 28.

As a further feature of the valving system used in the present invention, an open water source valve 40 allows the system operator to dilute the muriatic acid with water as it is pumped through the system to the cleaning wand 20. In this way, a water-acid mixture of variable concentration, depending upon the degree to which the first carboy valve 38 and the water source valve 40 are opened, may be applied to the pool surfaces. Conventional flow meters 54 are used at selected points in the system to monitor the rate of liquid flow therethrough.

Upon completion of a pool cleaning operation, the system may be flushed with water by closing the first and second carboy valves 38 and 44 and opening the water source valve 40 and the wand valve 42. Water is then pumped through the pool cleaning system 10 so that substantially no corrosive muriatic acid is permitted to remain within the system conduits 14.

The pool cleaning apparatus 10 may also be used to add a neutralizing agent, such as a carbonate, to the pool water in order to make the pool chemically safe for swimmers after a thorough cleaning with muriatic acid. This may be accomplished by removing the system conduits 14 from the cleaning agent carboy 16 and substituting therefor a source of the neutralizing agent. The valve sequencing arrangement described above for application of muriatic acid to pool and deck surfaces may be similarly used to add the carbonate to the water. For this application, however, the wand may be used like a hose to apply the chemical, rather than as a scrubbing apparatus.

Turning to FIGS. 4 through 9, another embodiment of a pool cleaning apparatus is indicated generally by the reference numeral 110. The apparatus 110 is employed to clean the surfaces of a swimming pool and surrounding areas by applying muriatic acid, liquid chlorine, or other suitable cleaning agent to the surfaces to be cleaned. It has been found, for example, that muriatic acid is effective in removing stains and other deposits on the surfaces of the pool, whereas liquid chlorine is effective in removing algae and other inert substances from the pool.

Figure 4:
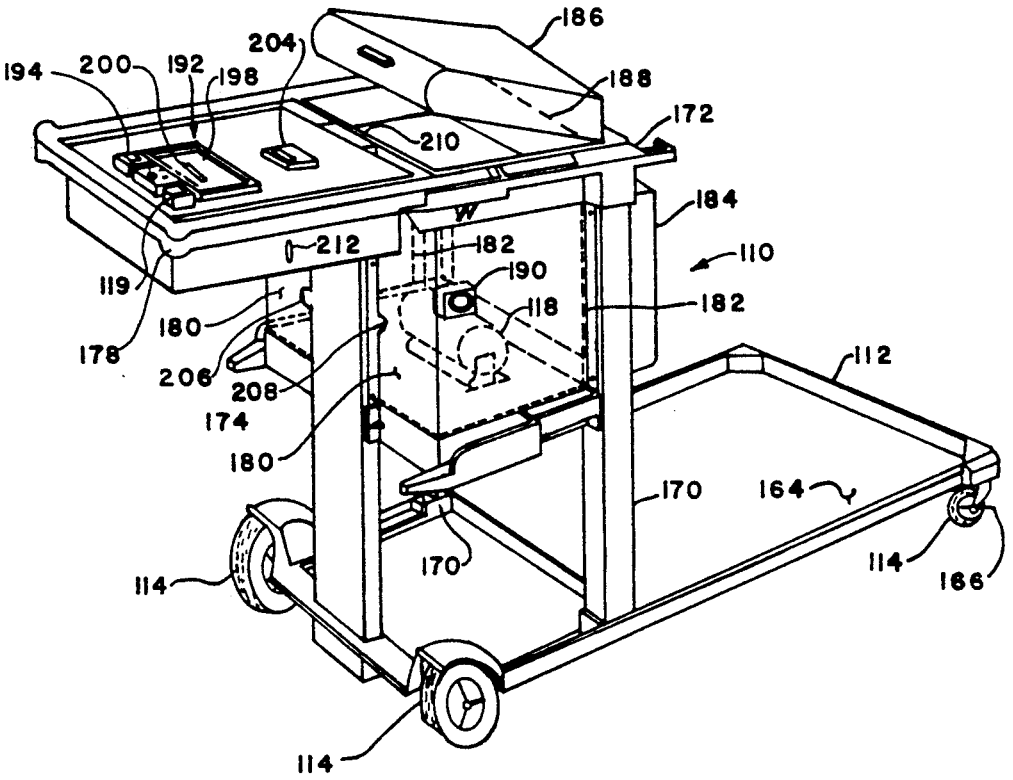
FIG. 4 is a perspective view of another apparatus embodying the invention showing the cart and control box of the apparatus.
Figure 5:
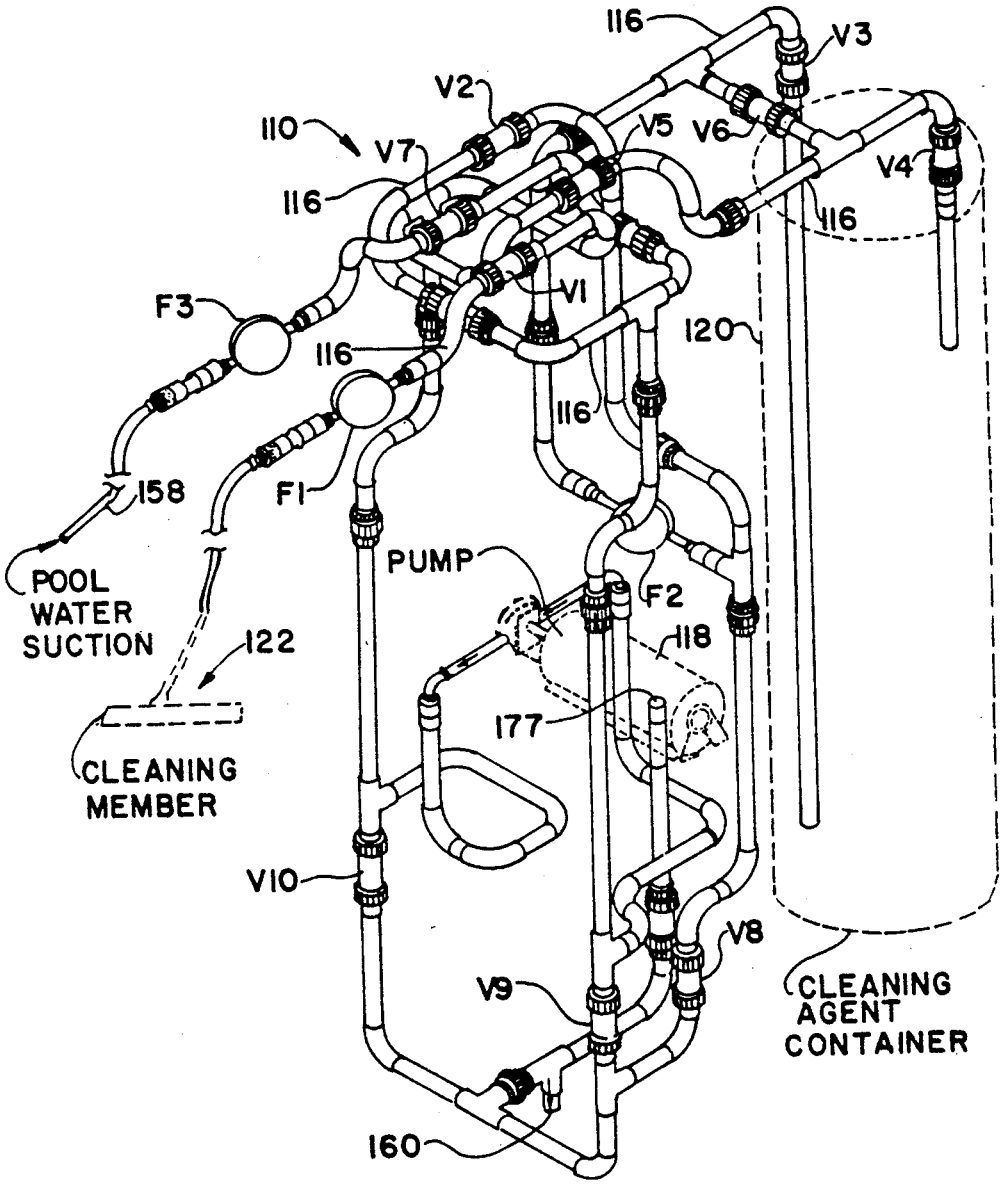
FIG. 5 is a perspective view of part of the apparatus of FIG. 4 illustrating the fluid conduits, flow meters and valves of the apparatus and illustrating in phantom the cleaning member, pump, and cleaning agent container of the apparatus.

In FIG. 4, the apparatus 110 is shown including a portable cart 112 mounted on wheels 114, 114 for transporting components of the apparatus 110. Turning to FIG. 5, fluid conduits 116, 116 of the apparatus 110 are illustrated. The fluid conduits are mounted to the cart 112 shown in FIG. 4, and are connected in fluid communication with a fluid pump 118 (shown in phantom), a cleaning agent container 120 (shown in phantom), and a cleaning member indicated generally as 122 (also shown in phantom).

The fluid pump 118 may be the same as the pump 22 described above in relation to the previous embodiment. The cleaning agent container 120 is preferably the container within which a suitable cleaning agent, such as muriatic acid, liquid chlorine, or other agent is commercially transported. The cleaning agent container 120 and fluid conduits 116, 116 may be the same as the carboy 16 and system conduits 14, respectively, described above in relation to the previous embodiment. The conduits 116, 116 are preferably formed of a plastic material impervious to muriatic acid or other pool cleaning agents. During the operation of the apparatus 110, pool cleaning agent is pumped from the container 120 by the pump 118, through the conduits 116, 116 and, in turn, through the cleaning member 122 for cleaning the surfaces of a pool, as will be described in further detail below.

Figure 6:
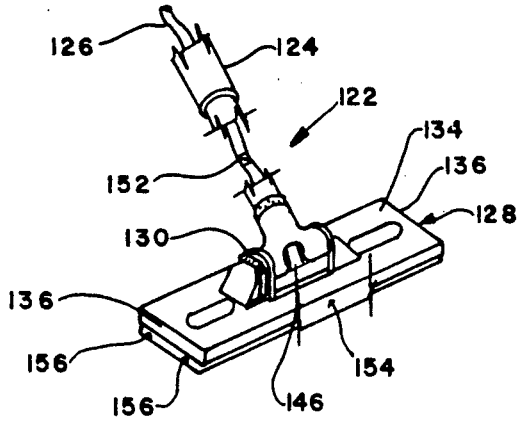
FIG. 6 is a perspective view of the cleaning member of the apparatus of FIG. 5.

Turning to FIG. 6, the cleaning member 122 is shown in detail, and includes a handle 124 having a flexible fluid conduit 126 fitted therethrough. The handle 124 is adjustable in length and may be the same as the handle 26 described above in relation to the previous embodiment. A cleaning head 128 of the cleaning member 122 is pivotally connected to one end of the handle 124 by means of a bracket 130. As can be seen, the cleaning head is rotatable about an axis substantially perpendicular to the longitudinal axis of the handle 124, so that the cleaning head can be rotated with respect to the handle 124 when cleaning a pool. The cleaning head 128 is preferably formed of a plastic material which is impervious to muriatic acid or other cleaning agents. The cleaning head 128 is also preferably flexible so that it will bend when pressed by the handle 124 to conform to the contour of the surfaces of a pool. The bracket 130 may be fastened to the cleaning head 128 or preferably injection molded as an integral part thereof.

Figure 7:
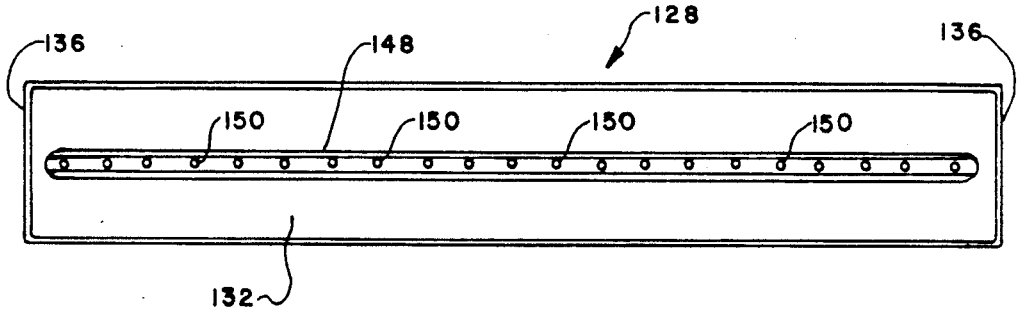
FIG. 7 is a bottom planar view of the cleaning member of FIG. 6.
Figure 8:
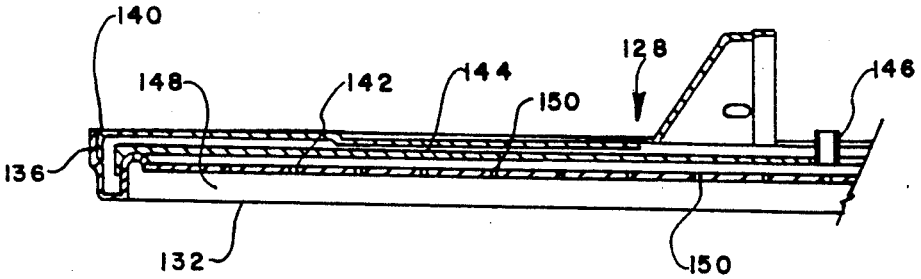
FIG. 8 is a partial cross-sectional view of the cleaning member of FIG. 6.

The cleaning head 128 defines a bottom face 132, as shown in FIG. 7. The cleaning head also defines a top face 134, and end faces 136, 136, as shown best in FIG. 6. Turning to FIG. 8, the cleaning head 128 further defines a ballast cavity 140 and a cleaning fluid cavity 142, the ballast cavity and cleaning fluid cavity being separated by a wall 144. A fitting 146 of the apparatus places the cleaning fluid cavity 142 in fluid communication with the flexible conduit 126. The fitting 146 is mounted on one end through the wall 144 of the cleaning head 128, and is connected on its other end to the end of the flexible conduit 126. As can be seen, fluid flowing through the conduit 126 flows through the fitting 146 and, in turn, flows directly into the cavity 142 of the cleaning head.

As shown in FIG. 7, a manifold cavity 148 is formed in the bottom face 132 of the cleaning head 128, and extends along a substantial portion of its length. The bottom surface of the manifold cavity 148 has formed therein a plurality of apertures 150, 150 spaced in the lengthwise direction of the cavity 148. The apertures 150, 150 permit fluid flow between the manifold cavity 148 and the cleaning fluid cavity 142 located above. As can be seen, fluid flowing through the conduit 126 enters the cleaning fluid cavity 142 through the fitting 46 and, in turn, flows into the manifold cavity 148 through the apertures 150, 150.

A check valve 152 of the apparatus, of a type known in the art, is mounted within the flexible conduit 126, and permits fluid flow through the conduit 126 only in the direction toward the cleaning head 128. A permeable covering 154 of the apparatus, shown partially in FIG. 6, is attached to the cleaning member 128 and wrapped over the bottom face 132 to cover the manifold cavity 48. In this way, cleaning agent flowing into the manifold cavity 148 does not disperse immediately into the pool water, but is initially retained beneath the covering 154, and thus flows through the covering and onto the surface to be cleaned. The covering 154 becomes saturated with cleaning agent and operates to remove stains, and to remove particles on the pool surfaces loosened by reaction with the cleaning agent, when the covering is slideably engaged over those surfaces, as will be described further below. The permeable covering 154 also assists in preventing pool water from filling the manifold cavity 148, and, accordingly, prevents the cleaning agent flowing against the pool surfaces from becoming diluted with water.

The end faces 136, 136 of the cleaning head 128 further define ballast apertures 156, 156, which permit pool water to flow into the ballast cavity 140 when the cleaning head 128 is submerged in a pool. When pool water flows through the ballast apertures 156, 156 and into the ballast cavity 140, the cleaning head 128 loses its buoyancy, and thus becomes more easily moveable along the submerged surfaces of the pool. In the event that any cleaning agent leaks from the cleaning fluid cavity 142, the water in the ballast cavity helps to dilute the cleaning agent and to wash it away. When the cleaning head 128 is removed from the pool, the pool water flushes out of the ballast cavity through the ballast apertures 156, 156 and back into the pool.

Figure 9:
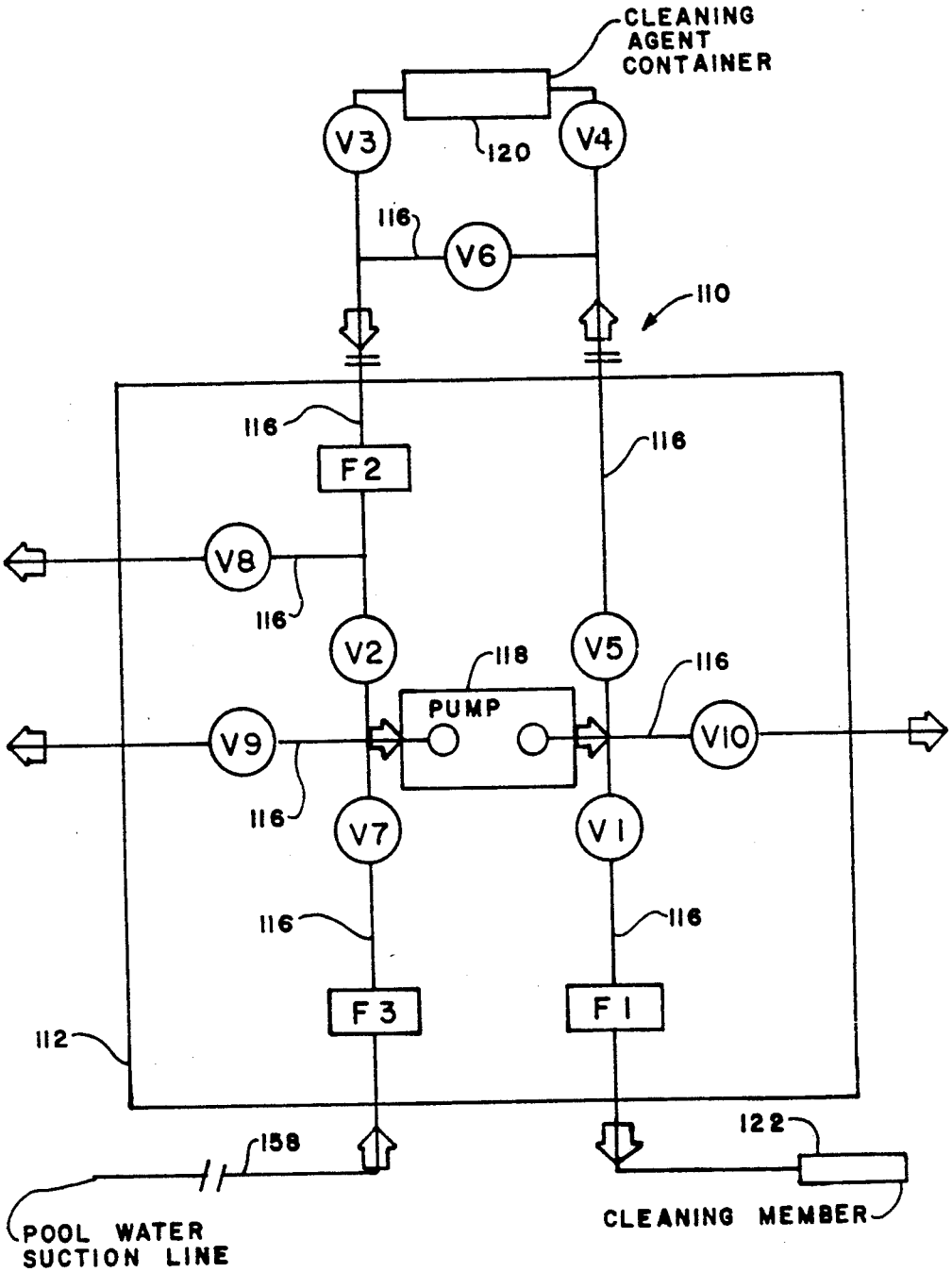
FIG. 9 is a schematic diagram of the apparatus of FIGS. 4 and 5.

In FIG. 9 the apparatus 110 is illustrated schematically, the arrows indicating the direction of fluid flow through the conduits 116, 116. The apparatus 110 further comprises several flow meters, also shown in FIG. 5, which may be the same as the flow meters described above in relation to the previous embodiment. A first flow meter F1 is mounted in the fluid conduit 116 in front of the cleaning member 122, to measure the flow rate of fluid entering the cleaning member. The apparatus 110 also comprises several valves, which may be the same as the valves described above in relation to the previous embodiment, and which include a first valve V1 connected to the conduit 116 between the outlet of the pump 118 and the flow meter F1. The rate of fluid flow from the pump 118 to the cleaning member 122 is controlled by adjusting the valve V1 until the desired flow rate is indicated by the flow meter F1.

A second valve V2 is connected to the fluid conduit 116 in front of the inlet port of the pump 118. The valve V2 may be adjusted to control the flow rate of cleaning agent from the container 120 into the pump 118. A second flow meter F2 is mounted in the fluid conduit 116 between the valve V2 and container 120, for measuring the flow rate of cleaning agent from the container 120 to the pump 118. A third valve V3 is connected to the fluid conduit 116 between the flow meter F2 and outlet of the container 120, and is opened to permit the flow of cleaning agent from the container into the conduits 116, 116. The flow rate of cleaning agent from the container 120 to the inlet port of the pump 118 is controlled by adjusting the valve V2 until the desired flow rate is indicated by the flow meter F2.

A fourth valve V4 is connected to the fluid conduit 116 in front of the inlet of the container 120 and is opened to permit the flow of cleaning agent to return to the container. A fifth valve V5 is, in turn, connected to the conduit 116 between the discharge port of the pump 118 and valve V4, for controlling the flow of fluid between the discharge port of the pump and the container 120. When the valve V4 is opened, valve V5 may be adjusted to control the return flow of cleaning agent into the container 120.

A sixth valve V6 is connected to the conduit 116 between the conduits connected to the outlet of the container 120 and the conduits connected to the inlet of container 120, shown best schematically in FIG. 9. Valve V6 is provided for flushing pool water throughout the conduits 116, 116 when the valves controlling the flow of cleaning agent to and from the container 120, V4 and V3, respectively, are closed, as will be described in further detail below.

A pool water suction line 158 of the apparatus 110 is connected to the inlet port of the pump 118 through the fluid conduit 116. The suction line 158 is preferably a flexible plastic hose and is provided for pumping water from the pool through the conduits 116, 116 and, in turn, back into the pool through the cleaning member 122. A third flow meter F3 is mounted in the fluid conduit 116 between the pool suction line 158 and the inlet port of the pump 118. The flow meter F3 measures the flow rate of fluid from the pool into the conduits 116, 116. A seventh valve V7 is connected to the conduit 116 between the pool suction line 158 and the inlet to the pump 118. The flow rate through the pool suction line is controlled by adjusting the valve V7 until the desired flow rate is indicated by the flow meter F3.

An eighth valve V8 is connected to the conduit 116 branching off between valve V2 and valve V3. As shown in FIG. 5, the outlet side of valve V8 opens into a drain 160 of the apparatus which, in turn, opens toward the floor below the cart 112. A ninth valve V9 also opens into the drain 160, and is connected to the fluid conduit 116 branching off in front of the inlet port of the pump 118. Similarly, a tenth valve V10 is connected to the fluid conduit 116 branching off in front of the discharge port of the pump 118, and also opens into the drain 160. The valves V8, V9, and V10 are provided to drain the conduits 116, 116 when the apparatus 110 is not in use. The apparatus 110 is preferably placed over a pool or deck drain and the valves V8, V9, and V10 are opened to allow any fluids in the apparatus 110 to flow through the drain 160 and into the pool or deck drain below.

Turning again to FIG. 4, the cart 112 includes a bottom frame 162 having a support surface 164 for mounting the container 120 (not shown). The front wheels 114, 114 of the cart have attached thereto rotatable wheel locks 166, 166, of a type known in the art, for preventing the cart 112 from moving when rotated into a locked position. The cart 112 further includes a rear vertical support 168 and two side vertical supports 170, 170. The bottom end of each vertical support is mounted to the bottom frame 162. A top frame 172 of the cart 112 is, in turn, mounted to the other end of each vertical support. A middle frame 174 of the cart is mounted to each vertical support between the bottom frame 162 and top frame 172. The middle frame 174 has a support surface 176 for mounting the pump 118 (shown in phantom) and fluid conduits 116, 116 (not shown). A conduit orifice 177 of the apparatus, as shown in FIG. 5, is mounted within the surface 176 of the cart for draining fluid that may leak onto that surface into the conduit drain 160, as will be described further below. A handle member 178 of the cart is connected to the top frame 172 for pushing and steering the cart.

As also shown in FIG. 4, the apparatus 110 further includes two side panels 180, 180 for enclosing the conduits 116, 116 (not shown), the pump 118, and other components mounted within the space between the middle frame 174 and top frame 172. Each panel 180 is connected to a respective side vertical support 170 by a hinge member 182. As can be seen, each panel 180 covers substantially the entire side and rear opening between the top frame 172 and middle frame 170, thus defining a substantially enclosed space therein. However, the panels 180, 180 provide for openings (not shown) between the panels and the top frame 172 to permit air flow therethrough, as will be described further below. The panels 180, 180 may be opened to access the components within that space by rotating the panels about their respective hinge members 182, 182. A front panel 184 of the apparatus, having a substantially rectangular configuration, is mounted to the front of the cart 112 and is fastened to each side vertical support 170. As shown, the front panel 184 covers the front opening between the top frame 172 and middle frame 174. A top panel 186 of the apparatus is connected on its front edge by a hinge member 188 (shown in phantom) to the top frame 172. The top panel 186 is rotatable about the hinge member 188 to cover the opening in the top frame 172 above the support surface 176. The side panels 180, 180, front panel 184, and top panel 186 are preferably made of transparent plastic material impervious to muriatic acid or other cleaning agents.

A fan 190 of the apparatus is mounted within a side panel 180 for circulating air through the space enclosed by the panels. The fan 190 draws air through the openings (not shown) between the panels 180, 180 and the top frame 172, and thus cools the pump and other electrical components of the apparatus. In the event that any of the fluid conduits 116, 116 within the space enclosed by the panels develop a leak, the panels will generally prevent the leaking fluid from contacting the operator. The leaking fluid will likely flow against the panels and onto the support surface 176, and, in turn, flow into the conduit orifice 177, shown in FIG. 5. The leaking fluid then flows through the drain 160 and onto the floor, or into a floor drain below (not shown). The operator, upon observing the leak through the transparent panels, can then shut down the pump.

The apparatus 110 further includes a control box indicated generally as 192. The control box 192 includes a start switch 194 and stop switch 196, each electrically connected to the pump 118 for controlling its operation. A digital flowmeter 198 of the apparatus, of a type known in the art, including a digital readout 200, is electrically connected through a flow meter switch 202, also known in the art, to each of the flow meters F1, F2, and F3. The digital readout 200 indicates the fluid flow as measured by each respective flow meter. The operator selects the flow meter to be monitored by setting the flow meter switch 202. Accordingly, the operator can monitor each flow meter F1, F2, and F3 during the operation of the pump. If the flow rate is not at the desired level, the operator may then adjust the respective valve until the flow meter 198 indicates the correct reading.

The apparatus 110 further includes an hour meter 204, of a type known in the art, mounted to the panel 192 and electrically connected to the pump 118. Each moment of operation of the pump 118 is recorded by the hour meter 204. The maintenance of the apparatus 110 can thus be scheduled depending upon the duration of the pump's operation.

The apparatus 110 further includes a first contact switch 206 mounted on one side of the rear vertical support 168, and a second contact switch 208 mounted on the other side of the rear vertical support 168, as shown in FIG. 4. Each contact switch 206 and 208 is electrically connected in series with the pump 118, and is mounted to maintain contact with a respective side panel 180 when the panel is closed. A third contact switch 210 is also electrically connected in series with the pump 118, and is mounted to the top frame 172 to maintain contact with the top panel 186 when that panel is closed. The contact switches 206, 208, and 210 are known in the art, and operate such that if any of the panels are open, the respective switch opens and interrupts the power supply, thus preventing operation of the pump. The apparatus 110 therefore should not be operable unless each of the panels are closed.

The apparatus 110 further includes a tilt switch 212, of a type known in the art, electrically connected in series with the pump 118 and mounted to the control box 192, as shown in FIG. 4. If the cart 112 is knocked over, the tilt switch 212 opens and thus cuts the power supply to shut down the pump.

Before cleaning a pool with the apparatus 110, the pump 118 is turned off and all valves of the apparatus, V1 through V10, are closed. The inlet and outlet ports of the cleaning agent container 120 are then connected to the fluid conduits 116, 116, as shown in FIG. 5.

To begin cleaning the pool, the valves V2 and V3 are opened and the pump 118 is operated to pump cleaning agent from the container 120 into the conduits 116, 116, as indicated by the arrow shown in FIG. 9. Valve V1 is then opened to pump the cleaning agent to the cleaning member 122 for cleaning the surfaces of the pool. The flow rate of cleaning agent flowing from the container 120 is controlled by adjusting the valves V2 and/or V3 until the desired flow rate is indicated by the flow meter F2. Similarly, the flow rate of cleaning agent flowing from the pump 118 to the cleaning member 122 is controlled by adjusting the valve V1 until the desired flow rate is indicated by the flow meter F1. In the preferred embodiment, the flow rate of cleaning agent to the cleaning member is about one gallon per minute, as will be described further below.

While cleaning agent is pumped to the cleaning member 122, the valves V4 and V5 are preferably opened to permit any overflow of cleaning agent from the discharge port of the pump to bleed through valve V5 and, in turn, through valve V4, and into the cleaning agent container 120. One advantage of opening the valves V4 and V5 is that it minimizes the risk of any fluid pressure buildup within the conduits 116, 116. In the event that the conduits do develop a leak, the cleaning agent will likely only drip onto the apparatus 110.

To clean the surfaces of a pool, the operator holds the cleaning member 122 by the adjustable handle 124 and submerges the cleaning head 128 into the pool. The operator then slides the permeable covering 154 of the cleaning head 128 across the surfaces of the pool. The flexibility of the cleaning head 128 permits the covering 154, wrapped over the bottom face 132 of the cleaning head, to conformably engage the surfaces of the pool.

As the cleaning head is moved over the surfaces to be cleaned, cleaning agent is pumped into the cleaning fluid cavity 142. The cleaning agent then flows through the apertures 150, 150 at a substantially even pressure and flow rate and into the manifold cavity 148. The cleaning agent is directed by the manifold cavity 148, through the permeable covering 154, and against the surfaces to be cleaned. As described above, the flow rate of cleaning agent is set at about one gallon per minute. In this way, the pressure of the cleaning agent flowing through the manifold cavity 148 is about equal to, or slightly above the hydrostatic pressure of the surrounding water in the pool. The cleaning agent, therefore, which is generally heavier than water, flows in a substantially laminar-type flow against the surfaces of the pool. If the flow rate of the cleaning agent is too high, for example, greater than about 5 gallons per minute, the cleaning agent may not effectively clean the surfaces of the pool. A relatively high flow rate will cause turbulence between the cleaning head 128 and the surfaces of the pool and, in turn, cause the cleaning agent to become diluted with pool water before it can completely clean the surface of the pool. The cleaning head 128 of the apparatus 110, therefore, conformably engages the surfaces of the pool and directs a substantially laminar flow of undiluted cleaning agent against the surfaces to be cleaned.

The reaction between the cleaning agent and any deposits on the surfaces of the pool dissolves the deposits into the water of the pool. Also, the permeable covering 154, which becomes saturated with cleaning agent, operates to remove any other debris loosened by reaction with the cleaning agent, but not otherwise dissolved into the pool water. The surfaces of the pool, therefore, are cleaned without removing any water from the pool. Likewise, the pool surfaces are cleaned without applying the cleaning agent at a high velocity and/or under increased pressure, as with some known pool cleaning devices. In the event that any of the conduits 116, 116 do develop a leak, the low flow rate and low fluid pressure in the conduits will likely prevent the cleaning agent from spraying through the leak. The apparatus of the invention, therefore, provides a means of cleaning a pool with ordinarily dangerous cleaning agents under safe operating conditions when properly used. Moreover, because the muriatic acid or other cleaning agent is applied to primarily submerged surfaces of the pool, there is less concern for the hazardous fumes ordinarily produced by the cleaning agent when used without any water in the pool. After all of the pool surfaces are cleaned, the deposits are removed by the pool's filtration system and/or by vacuuming the floor of the pool.

The apparatus 110 may also be employed to apply a diluted mixture of cleaning agent, for example, when cleaning the pool surfaces above the water line and/or the deck surfaces surrounding the pool. In this case, the free end of the pool water suction line 158 is submerged in the pool. The valve V7 is then opened to mix pool water with the cleaning agent flowing into the inlet port of the pump 118. When diluting the cleaning agent with water, the valve V5 is preferably closed so that diluted cleaning agent does not return back into the container 120. The concentration of the diluted cleaning agent is controlled by adjusting the relative flow rates of the water and cleaning agent flowing into the inlet port of the pump 118. The flow rate of water into the pump is controlled by adjusting valve V7 until the desired flow rate is indicated by the flow meter F3. Similarly, as described above, the flow rate of the cleaning agent is controlled by adjusting valve V2 and/or valve V3 until the desired flow rate is indicated by the flow meter F2.

After all of the surfaces of the pool are cleaned, the muriatic acid or other cleaning agent is flushed from the apparatus 110 by closing valves V3 and V4 to isolate the cleaning agent container 120, and by closing the drainage valves V8 through V10. The free end of the pool suction line 158 is submerged in the pool and the valves V1, V2, V5, V6 and V7 are opened, and the pump 118 is then operated to flush pool water through the conduits 116, 116 and into the cleaning member 122. The cleaning head 128 is suspended over the pool to allow the pool water to flow back into the pool. By closing valves V3 and V4, and opening valve V6, the pool water flow bypasses the cleaning agent container 120 and flushes the cleaning agent from the other components of the apparatus 110 and into the pool. If the container 120 is empty, it may also be flushed by opening valves V3 and V4 and closing valve V6 to allow the pool water to flush through the container 120 and back into the pool. After the apparatus 110 is flushed with pool water, the cart 112 is moved over a pool or deck drain and valves V8, V9, and V10 are opened to allow any pool water in the conduits 116, 116 to flow through the drain 160 and into the pool or deck drain below.

After the pool is cleaned, a neutralizing agent is added to the pool to make the water chemically safe for swimmers. If muriatic acid is used as a cleaning agent, an alkaline neutralizing agent, of a type known in the art, is added to the pool water to raise the PH level to normal conditions. The apparatus 110 may be employed to add the neutralizing agent to the pool by replacing the cleaning agent container 120 with a similar container containing neutralizing agent. The neutralizing agent is pumped through the cleaning member 122 and into the pool in the same way as described above for applying cleaning agent to the pool. However, the cleaning head 128 may either be suspended over the water in the pool, or submerged in the pool. After the neutralizing agent is added to the pool, the apparatus 110 is then flushed with pool water and drained as described above.

An alternative method for maintaining chemically safe water conditions in the pool is to add an alkaline neutralizing agent to the pool while cleaning the pool. The alkaline neutralizing agent may be placed in a permeable bag or similar type of container (not shown). One or more such bags may then be placed on the floor of the pool prior to cleaning the pool. The bags are preferably placed adjacent the drains in the floor of the pool. When the cleaning agent, which is generally heavier than water, is applied to the surfaces of the pool, the cleaning agent flows toward the floor of the pool and, in turn, eventually flows toward the floor drains. The bags of neutralizing agent, therefore, neutralize the cleaning agent before it flows into the floor drains of the pool. The permeable bag permits the cleaning agent to flow through the bag and react with the alkaline neutralizing agent therein. In this way, the cleaning agent cannot flow into the floor drains and damage any system components of the pool. The bags of neutralizing agent may be left in the pool after the cleaning operation is completed until the PH level of the pool reaches normal conditions.

The invention in its broader aspects is not limited to the specific embodiments herein shown and described but departures may be made therefrom within the scope of the accompanying claims, without departing from the principles of the invention and without sacrificing its chief advantages.

I claim:

1. A portable pool cleaning system for cleaning swimming pool surfaces and surrounding decks including the removal of stains therefrom without draining the water from the pool, comprising:

a cart, said cart having conduit means mounted thereon for the flow of liquid therethrough, said conduit means being connectable in fluid communication with an external source of liquid cleaning agent and with a separate, external source of water;

a cleaning wand of adjustable length removably attachable to said conduit means for fluid communication therewith, said cleaning wand having a cleaning head pivotally mounted on one end thereof adapted for conformable engagement with the pool and deck surfaces, said cleaning head including scrubbing means for applying the liquid cleaning agent to the pool and deck surfaces and further defining a passageway therein for directing liquid flow against the surfaces to be cleaned;

a pump mounted on said cart and in fluid communication with said conduit means for selectively delivering liquid cleaning agent and water to said cleaning wand;

valve means for controlling the delivery of liquid cleaning agent and water to said cleaning wand, said valving means including means for recirculating liquid cleaning agent through said pool cleaning system;

safety shield means for preventing leakage of cleaning agent from said pool cleaning system; and means for detecting whether said safety shield means is activated.

2. The invention of claim 1, said pool cleaning system further comprising a system switch electrically connected to said pump for actuating said pump, and said detecting means comprises at least one safety switch electrically wired in series with said system switch, said safety switch being closed by the activation of said safety shield means, whereby the pump is inoperable when said safety shield means is deactivated.

3. The invention of claim 2 wherein said safety shield means includes at least one generally cylindrical safety shield for enclosing mechanical interconnections of said valving means.

4. A portable pool cleaning system for cleaning swimming pool surfaces and surrounding decks including the removal of stains therefrom without draining the water from the pool, comprising:

a cart, said cart having conduit means mounted thereon for the flow of liquid therethrough, said conduit means being connectable in fluid communication with an external source of liquid cleaning agent and with a separate, external source of water;

a cleaning wand of adjustable length removably attachable to said conduit means and in fluid communication therewith, said cleaning wand having a cleaning head pivotally mounted on one end thereof adapted for conformable engagement with the pool and deck surfaces, said cleaning head including permeable scrubbing means for applying liquid cleaning agent to the pool and deck surfaces and further defining a cavity therein bounded on one side by said permeable scrubbing means for directing liquid flow against surfaces to be cleaned; and means for controlling the flow of cleaning agent and/or water at a flow rate less than about five gallons per minute into said cavity to facilitate the application of a substantially predetermined concentration of cleaning agent against submerged surfaces to be cleaned, and including a pump mounted within said cart and coupled in fluid communication with said conduit means for delivering liquid cleaning agent to said cleaning wand and onto the surfaces to be cleaned.

5. The invention of claim 4 further comprising:

valving means for controlling the flow of liquid cleaning agent to said cavity at a pressure slightly greater than the pressure within said cavity.

6. The invention of claim 5 wherein said valving means comprises:

a first valve connected to said conduit means for controlling the flow of liquid cleaning agent from said conduit means to said cleaning wand, whereby the pressure of liquid cleaning agent entering said cavity may be adjusted by adjusting said first valve.

7. An apparatus for cleaning the surfaces of a swimming pool and surrounding areas, said apparatus comprising:

fluid conduit means for the flow of fluid therethrough, said conduit means being connectable to a source of liquid cleaning agent for the flow of cleaning agent therethrough;

valve means connected to said conduit means for controlling the flow of cleaning agent or other fluid through said conduit means;

a cleaning member connectable to said conduit means for receiving cleaning agent or other fluid therefrom, said cleaning member defining a cleaning surface adapted for substantial conformable engagement with the surfaces to be cleaned, said cleaning surface having formed therein a cavity, said cavity being in fluid communication with said conduit means when said cleaning member is connected thereto for receiving cleaning agent or other fluid therefrom; and means for controlling the flow of cleaning agent into said cavity at a flow rate less than approximately five gallons per minute to facilitate the application of a substantially predetermined concentration of cleaning agent against submerged surfaces to be cleaned.

8. An apparatus as defined in claim 9, wherein said means for controlling includes:

a pump in fluid communication with said conduit means for pumping cleaning agent or other fluid through said conduit means.

9. An apparatus as defined in claim 8, wherein said conduit means are connectable to a source of water for pumping water therethrough so that water can be mixed with cleaning agent to dilute the concentration of cleaning agent flowing against the surfaces to be cleaned and/or to flush water through said conduit means to remove cleaning agent therefrom after the surfaces are cleaned.

10. An apparatus as defined in claim 7, wherein said cleaning member comprises:

a handle having a handle fluid conduit therein, said handle fluid conduit being connectable to said fluid conduit means for receiving cleaning agent or other fluid therefrom; and a cleaning head connected to one end of said handle, said cleaning head defining said cleaning surface adapted for substantial conformable engagement with the surfaces to be cleaned, said cleaning head further defining said cavity formed within said cleaning surface, said cavity being in fluid communication with said handle fluid conduit for receiving cleaning agent or other fluid therefrom, and for directing the flow of cleaning agent against the surfaces to be cleaned.

11. An apparatus as defined in claim 10, wherein said cleaning head is made of a flexible plastic material for facilitating substantial conformable engagement of said cleaning surface with the surfaces to be cleaned.

12. An apparatus as defined in claim 8, wherein said valve means includes a first valve connected to said conduit means between the discharge port of said pump and said cleaning member, said first valve being operable to control the flow of cleaning agent or other fluid to said cleaning member.

13. An apparatus as defined in claim 8, wherein said valve means includes a second valve connected to said conduit means between the source of liquid cleaning agent and the inlet port of said pump, said second valve being operable to control the flow of cleaning agent to said pump.

14. An apparatus as defined in claim 7, said apparatus further comprising:

a permeable cover attached to said cleaning member over said cleaning surface and covering said cavity formed therein, said permeable cover being interposed between said cleaning surface and the surfaces to be cleaned for permitting the flow of cleaning agent therethrough and against the surfaces to be cleaned.

15. An apparatus for cleaning the surfaces of a swimming pool and surrounding areas, said apparatus comprising:

fluid conduit means for the flow of fluid therethrough, said conduit means being connectable to a source of liquid cleaning agent for the flow of cleaning agent therethrough;

valve means connected to said conduit means for controlling the flow of cleaning agent or other fluid through said conduit means;

a cleaning member connectable to said conduit means for receiving cleaning agent or other fluid therefrom, said cleaning member defining a cleaning surface adapted for substantial conformable engagement with the surfaces to be cleaned, said cleaning surface having formed therein a cavity, said cavity being in fluid communication with said conduit means when said cleaning member is connected thereto for receiving cleaning agent or other fluid therefrom, said cleaning surface being engageable with the surfaces to be cleaned for directing the flow of cleaning agent through said cavity against the surfaces to be cleaned, said cleaning head further defining a ballast cavity, said ballast cavity being in fluid communication with the pool water when said cleaning head is submerged in a pool for receiving water therefrom, such that when said ballast cavity receives water, said cleaning head substantially loses its buoyancy for facilitating movement of said cleaning head over submerged surfaces to be cleaned.

16. An apparatus for cleaning the surfaces of a swimming pool and surrounding areas, said apparatus comprising:

fluid conduit means for the flow of fluid therethrough, said conduit means being connectable to a source of liquid cleaning agent for the flow of cleaning agent therethrough;

valve means connected to said conduit means for controlling the flow of cleaning agent or other fluid through said conduit means;

a cleaning member connectable to said conduit means for receiving cleaning agent or other fluid therefrom, said cleaning member defining a cleaning surface adapted for substantial conformable engagement with the surfaces to be cleaned, said cleaning surface having formed therein a cavity, said cavity being in fluid communication with said conduit means when said cleaning member is connected thereto for receiving cleaning agent or other fluid therefrom, said cleaning surface being engageable with the surfaces to be cleaned for directing the flow of cleaning agent through said cavity against the surfaces to be cleaned;

a pump in fluid communication with said conduit means for pumping cleaning agent or other fluid through said conduit means;

said conduit means being connectable to a source of water for pumping water therethrough so that water can be mixed with cleaning agent to dilute the concentration of cleaning agent flowing against the surfaces to be cleaned and/or to flush water through said conduit means to remove cleaning agent therefrom after the surfaces are cleaned; and said valve means includes a third valve connected to said conduit means between a source of water and the inlet port of said pump, said third valve being operable to control the flow of water to said pump.

17. An apparatus for cleaning the surfaces of a swimming pool and surrounding areas, said apparatus comprising:

fluid conduit means for the flow of fluid therethrough, said conduit means being connectable to a source of liquid cleaning agent for the flow of cleaning agent therethrough;

valve means connected to said conduit means for controlling the flow of cleaning agent or other fluid through said conduit means; and a cleaning member connectable to said fluid conduit means for receiving cleaning agent or other fluid therefrom, said cleaning member defining a cleaning surface formed on an external face thereof for substantial conformable engagement with the surfaces to be cleaned, said external face defining therein at least one aperture, said aperture being in fluid communication with said fluid conduit means for receiving cleaning agent or other fluid therefrom, and for directing the flow of cleaning agent or other fluid against the surfaces to be cleaned; and means for controlling the flow of cleaning agent into said aperture at a flow rate less than approximately five gallons per minute to facilitate the application of a substantially predetermined concentration of cleaning agent against submerged surfaces to be cleaned.

18. An apparatus as defined in claim 17, wherein said means for controlling includes:

a pump coupled in fluid communication with said conduit means for pumping cleaning agent or other fluid through said conduit means.

19. An apparatus as defined in claim 17, wherein said cleaning member further comprises:

a handle, said handle having a fluid conduit therein, said handle conduit being in fluid communication with said fluid conduit means for receiving cleaning agent or other fluid therefrom, said handle conduit also being in fluid communication with said aperture for permitting the flow of cleaning agent or other fluid from said conduit means, through said aperture, and against the surfaces to be cleaned.

20. An apparatus as defined in claim 17, said apparatus further comprising:

a permeable cover joined to said cleaning member and covering said cleaning surface and said aperture defined by said external face thereof, said cover permitting the flow of cleaning agent therethrough and against the surfaces to be cleaned.

21. An apparatus as defined in claim 17, wherein said conduit means are connectable to a source of water for the flow of water therethrough so that water can be mixed with cleaning agent to dilute the concentration of cleaning agent flowing against the surfaces to be cleaned and/or to flush water through said conduit means to remove cleaning agent therefrom after the surfaces are cleaned.

22. An apparatus as defined in claim 17, wherein said external face of said cleaning member defining said cleaning surface is made of a flexible plastic material for facilitating substantial conformable engagement of said cleaning surface with the surfaces to be cleaned.

23. An apparatus for cleaning the surfaces of a swimming pool and surrounding areas, said apparatus comprising:

fluid conduit means for the flow of fluid therethrough, said conduit means being connectable to a source of liquid cleaning agent for the flow of cleaning agent therethrough;

valve means connected to said conduit means for controlling the flow of cleaning agent or other fluid through said conduit means;

a cleaning member connectable to said fluid conduit means for receiving cleaning agent or other fluid therefrom, said cleaning member defining a cleaning surface formed on an external face thereof for substantial conformable engagement with the surfaces to be cleaned, said external face defining therein at least one aperture, said aperture being in fluid communication with said fluid conduit means for receiving cleaning agent or other fluid therefrom, and for directing the flow of cleaning agent or other fluid against the surfaces to be cleaned, said cleaning member further defining a ballast cavity, said ballast cavity being in fluid communication with the pool water when said cleaning member is submerged in the pool for receiving water therefrom, such that when said ballast cavity receives water, said cleaning member substantially loses its buoyancy for facilitating movement of said cleaning member over submerged surfaces to be cleaned.

24. An apparatus for cleaning the surfaces of a swimming pool and surrounding areas, said apparatus comprising:

fluid conduit means for the flow of fluid therethrough, said conduit means being connectable to a source of liquid cleaning agent for the flow of cleaning agent therethrough;

valve means connected to said conduit means for controlling the flow of cleaning agent or other fluid through said conduit means;

a cleaning member connectable to said fluid conduit means for receiving cleaning agent or other fluid therefrom, said cleaning member defining a cleaning surface formed on an external face thereof for substantial conformable engagement with the surfaces to be cleaned, said external face defining therein at least one aperture, said aperture being in fluid communication with said fluid conduit means for receiving cleaning agent or other fluid therefrom, and for directing the flow of cleaning agent or other fluid against the surfaces to be cleaned;

a pump coupled in fluid communication with said conduit means for pumping cleaning agent or other fluid through said conduit means;

safety shield means for enclosing said valve means and/or said fluid conduit means for preventing cleaning agent that may leak therefrom from contacting an operator; and means for detecting whether said safety shield means are enclosing said valve means and/or said fluid conduit means.

25. An apparatus as defined in claim 24, wherein said detecting means comprises:

at least one contact switch, said contact switch being electrically wired in series with said pump, said contact switch being mounted adjacent said safety shield means so that said contact switch is opened when said safety shield means is opened for preventing the operation of said pump.

* * * * *